US005980732A

United States Patent [19]

Gillis

[11] Patent Number: 5,980,732

[45] Date of Patent: Nov. 9, 1999

[54] INTEGRATED VACUUM RESIDUE HYDROTREATING WITH CARBON REJECTION

[75] Inventor: Daniel B. Gillis, Arlington Heights, Ill.

[73] Assignee: UOP LLC, Des Plaines, Ill.

[21] Appl. No.: 08/999,776

[22] Filed: Aug. 26, 1997

Related U.S. Application Data

[60] Provisional application No. 60/026,872, Oct. 1, 1996.

[51] Int. Cl.[6] ..... C10G 45/00

[52] U.S. Cl. ..... 208/210; 208/222

[58] Field of Search ..... 208/222, 210

[56] References Cited

U.S. PATENT DOCUMENTS

| | | | |
|---|---|---|---|
| 3,551,323 | 12/1970 | Hamblin | 208/58 |
| 3,719,589 | 3/1973 | Herbstmann et al. | 208/208 R |
| 4,039,429 | 8/1977 | van Klinken et al. | 208/50 |
| 4,062,758 | 12/1977 | Goudriaan et al. | 208/80 |
| 4,126,538 | 11/1978 | Goudriaan et al. | 208/80 |
| 4,715,947 | 12/1987 | Staggs | 208/68 |
| 4,808,298 | 2/1989 | Peck et al. | 208/212 |
| 5,242,578 | 9/1993 | Taylor et al. | 208/309 |
| 5,258,117 | 11/1993 | Kolstad | 208/309 |

*Primary Examiner*—Helane Myers
*Attorney, Agent, or Firm*—Thomas K. McBride; John F. Spears, Jr.

[57] ABSTRACT

The residue (bottoms) from a vacuum or atmospheric column is upgraded in a revamped multireactor hydrotreating zone. The hydrotreating zone is modified such that the entire effluent of the next to last reactor is withdrawn, light gases and hydrocarbons are removed from the effluent in separators and the remaining liquid is passed into a fractionation column and/or a carbon rejection zone. Gas oils and distillates from the column and/or carbon rejection zone are then returned to the last reactor of the hydrotreating zone.

8 Claims, 2 Drawing Sheets

INTEGRATED VACUUM RESIDUE HYDROTREATING WITH CARBON REJECTION

This application is related to and claims the benefit of the filing date of provisional application 60/026,872 filed Oct. 1, 1996.

FIELD OF THE INVENTION

The invention relates to a hydrocarbon conversion process for use in hydrotreating; e.g., desulfurization of petroleum-derived heavy oil fractions. The invention also relates to a method of revamping an existing multireactor hydrotreating unit to integrate the hydrotreating unit with a carbon rejection unit such as a deasphalting unit. The invention specifically relates to a multistep hydrocarbon conversion process in which a residue from a crude column is processed by steps including hydrotreating, vacuum fractionation, carbon rejection and further hydrotreating and/or hydrocracking to produce distillate hydrocarbons or a better quality feedstock for a downstream conversion unit.

RELATED ART

U.S. Pat. No. 3,551,323 issued to R. J. J. Hamblin illustrates a black oil conversion process designed to maximize the production of naphtha boiling range hydrocarbons. The feed and recycle streams are passed through an initial reactor with the effluent going through a hot separator and the vapor phase from the hot separator passing to a cold separator. The hot separator bottoms are fed into a vacuum flash unit with the vapor phase material from this unit being passed into for hydrocracking of the heavier hydrocarbons. U.S. Pat. No. 4,715,947 assigned to D. W. Staggs illustrates a somewhat similar process flow wherein an atmospheric residue stream is charged first to a thermal cracking unit with lighter material being passed eventually to a hydrogenation zone and the heavier material from the thermal cracking unit being passed into a vacuum tower. The lighter materials recovered from the vacuum tower are then passed into a hydrocracking zone 16.

U.S. Pat. No. 4,039,429 assigned to J. Van Klinken et al. illustrates a multistep process flow for treating residual hydrocarbon stocks obtained from atmospheric distillation. The series of steps includes hydrotreating, atmospheric, vacuum distillation, and deasphalting. U.S. Pat. No. 4,062,758 assigned to F. Goudriaan et al. also illustrates a multistep process flow for the conversion of an atmospheric distillate residue into distillate hydrocarbons. The residue is first subjected to vacuum distillation with the heavier materials subjected to hydrotreating, atmospheric distillation and a second vacuum distillation prior to the deasphalting of the remaining material. The lighter fraction from each of these stages is combined and fed to a hydrocracking unit. U.S. Pat. No. 4,126,538 assigned to F. Goudriaan et al. illustrates a similar process. The residual hydrocarbon stocks from vacuum distillation are converted into light distillates by a sequence of steps including vacuum distillation, deasphalting, hydrocracking, atmospheric distillation, hydrotreating, and a second atmospheric distillation.

U.S. Pat. No. 4,808,298 assigned to L. B. Peck et al. illustrates another hydrotreating process used to upgrade residue fractions obtained from crude oil. Residue derived from vacuum fractionation is passed through a series of ebulated bed reactors before entering a high pressure separator, the liquids from the high pressure separator are passed to a stripping column with the recovered liquids passing into an atmospheric fractionation column. The liquid phase material from this column is then fed into a hydrotreater which prepares the feed for an FCC unit.

SUMMARY OF THE INVENTION

Figure 1:
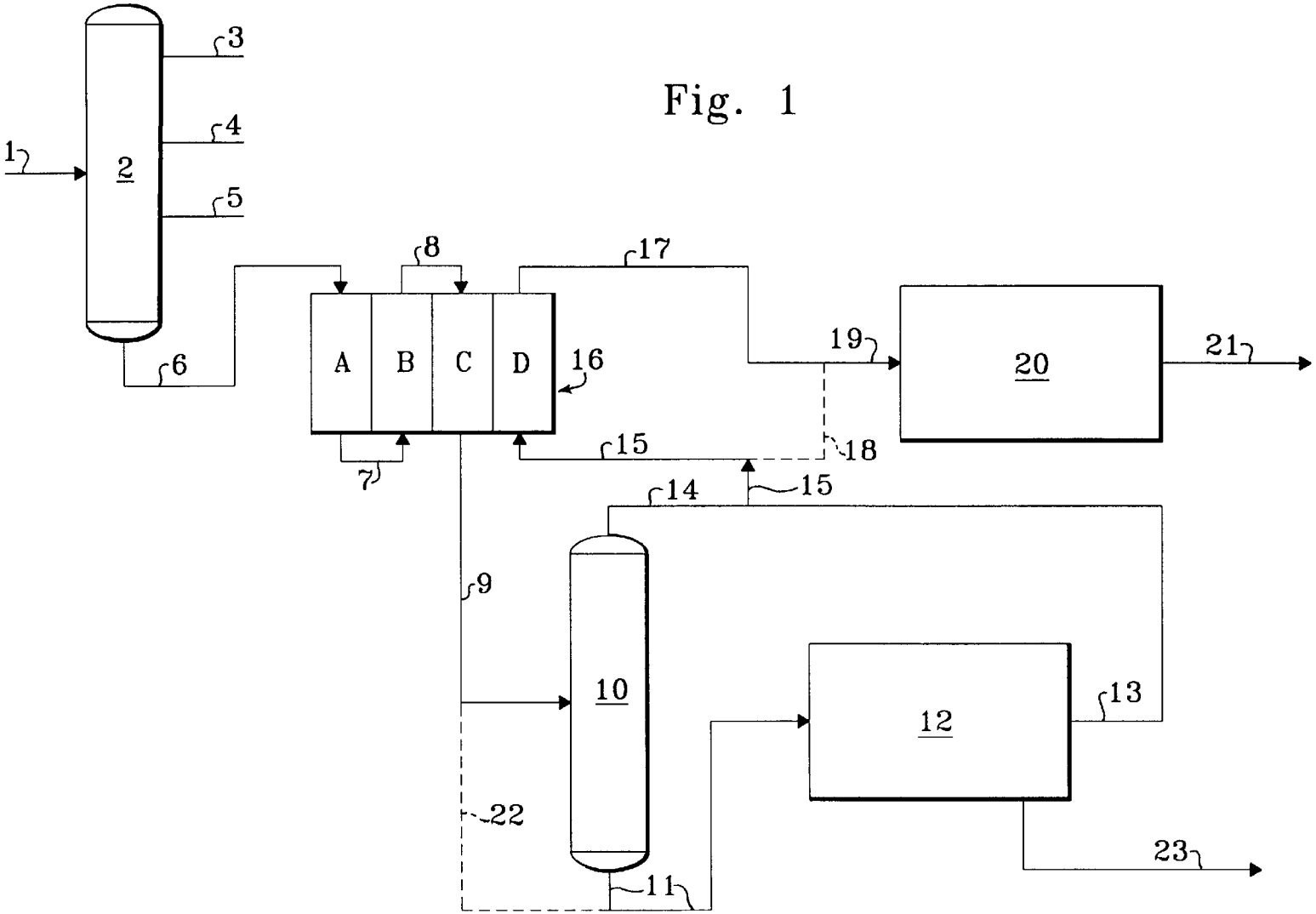
FIG. 1 is a simplified schematic diagram of the overall process flow of the invention showing a crude fractionation column 1, a hydrotreating unit 16, a vacuum fractionation column 10, a carbon rejection unit 12 and a conversion unit 20; e.g., an FCC unit.

The invention is an integrated hydrotreating process for desulfurization of the residue stream from a vacuum column of a petroleum refinery. The invention also encompasses a method of revamping an existing residue (reduced crude) hydrotreating unit having three or more separate reactors to increase the hydrotreating capacity of the unit and to increase the production of middle distillates. This improvement is achieved by removing the hydrocarbons being processed from the hydrotreating unit before passage into the last reactor of the hydrotreating unit and then passing the removed hydrocarbons through a carbon rejection zone, and returning gas oils recovered from the thus treated hydrocarbons into the last reactor of the hydrotreating zone, which preferably has been at least partially reloaded with a hydrocracking catalyst.

One broad embodiment of the invention may be characterized as a petroleum residue desulfurization process which comprises the steps of passing a petroleum-derived feed stream having a 50 percent boiling point above about 260° C. and containing at least 0.2 weight percent sulfur into a hydrotreating zone containing at least three reactors, with at least the first two reactors containing a hydrotreating catalyst and operated at hydrotreating conditions, passing the feed stream through the first two reactors in admixture with hydrogen, and then removing the partially hydrotreated effluent at the next to last reactor from the reaction zone, prior to passage through the last reactor of the hydrotreating zone, as a partially hydrotreated residue stream; separating hydrogen and light hydrocarbons from the partially hydrotreated residue stream, and then passing the remaining portion of the partially hydrotreated residue stream into a processing zone in which asphaltenes are concentrated into a high boiling residue stream and the remaining hydrocarbons are concentrated into a distillate stream; passing the distillate stream and hydrogen through the last reactor of the hydrotreating zone and recovering a hydrotreated product stream having a 50 percent boiling point above about 260° C.

DETAILED DESCRIPTION AND EMBODIMENTS

Several factors are driving petroleum refineries to modify their operating units to increase sulfur removal and/or increase conversion of heaviest or resid components of the crude oil charged to the refineries. These factors include changing environmental regulations and product standards governing the maximum allowable aromatic and sulfur content of distillate fuels, changing product price structures and changes in the crude oils available to a refinery. Often these factors make it desirable or even necessary for a refinery to increase the level of conversion and upgrading of heavier fractions derived from the crude oil. It is an objective of the subject invention to provide a method of revamping a residue hydrotreating unit to improve the quality of the distillate products recovered from the residue material charged to the hydrotreating unit. It is a further objective of the invention to provide an improved hydrotreating-carbon rejection flow scheme for use in petroleum refineries.

The normal feed to the subject process is a resid or bottoms fraction removed from an atmospheric or vacuum crude column which removes distillate hydrocarbons and light hydrocarbons from the crude oil. The feed may, however, be derived from other sources and may contain a fair amount; e.g., 25 volume percent or more distillates. The feed will be fairly high in sulfur and heavy compounds such as asphaltenes. A prime characteristic of the intended feed is a boiling point range including many high boiling hydrocarbons. A residue feed having a 50 percent (vol.) boiling point above about 316° C. (600° F.) is one example. If the feed is derived from a source which concentrates the heavy hydrocarbons into the residue to a greater extent, the 50 percent boiling point may be in the range of about 371° C. (700° F.) to 482° C. (900° F.). A vacuum column may produce a residue usable for feed to the subject process having a 50 percent boiling point above 538° C. (1,000° F.). The sulfur, metals and asphaltene content of the feed can vary widely depending upon the source and prior processing of the feed.

The subject invention has several advantages compared to a standard prior art operation in which the entire charge stock to the residue hydrotreating zone was passed through the entire residue hydrotreating zone and then passed into a conversion unit of the refinery. Among these advantages are the fact that the residue hydrotreater can now be operated at a lower severity which will increase cycle life, reduce hydrogen consumption, reduce catalyst consumption, or alternatively allow the processing of a lower quality residue. Another advantage is a reduced need for feed preheating. Furthermore, the gas oil or lighter distillate streams recovered from the carbon rejection and vacuum columns can now be partially hydrocracked in the last reactor of the residue hydrotreater to produce a higher percentage of distillates and a higher quality gas oil feedstock than was possible with the conventional residue hydrotreater.

A separate advantage which is derived when the subject invention is used in conjunction with a solvent deasphalting unit as the carbon rejection unit is that the residue product (pitch) is much lower in quantity and lower in contaminant levels than pitch from solvent deasphalters that process residues before hydrotreating. In general, improving the quality of the material charged to the carbon rejection unit will result in increased quality of the products of the carbon rejection unit. This is also realized in the specific case of the discriminatory destructive distillation process (3D process), with the flow scheme of the subject invention plus a 3D process unit resulting in an overall higher liquid yield than if the 3D process was followed by a subsequent hydrotreating unit. The subject invention as a feed prep for the 3D process also reduces the requirements for flue gas desulfurization and energy input to the 3D process.

Refined petroleum products generally have higher average hydrogen to carbon ratios on a molecular basis. Therefore, the upgrading of a petroleum refinery hydrocarbon fraction is classified into one of two categories: hydrogen addition and carbon rejection. Hydrogen addition is performed by, processes such as hydrotreating and hydrocracking. Carbon rejection processes typically produce a stream of rejected high carbon material which may be a liquid or a solid; e.g., coke deposits. Some carbon rejection processes such as FCC or the 3D process include cracking of heavy molecules. Others such as solvent deasphalting consist only of physical separation of the lighter and heavier hydrocarbons. For instance, in solvent deasphalting a light solvent such as a $C_4$ or $C_5$ hydrocarbon is used to dissolve or suspend the lighter hydrocarbons allowing the asphaltenes to be "precipitated". These phases are separated and then the solvent is recovered. Additional information on solvent deasphalting conditions, solvents and operations may be obtained from U.S. Pat. Nos. 4,239,616; 4,440,633; 4,354,922; and, 4,354,928.

The 3D process is one of the preferred carbon rejection processes for use in the subject invention. The 3D process name is derived from discriminatory destructive distillation. The process employs a circulating solid system with a reactor and a regenerator arranged similar to an FCC unit. However, the 3D process is a thermal process and uses a circulating solid which is not a conventional catalyst. The objective is to remove from the feed (residue) the least desirable components of the feed through thermal contact over a relatively short time. In the reactor high quality distillates in the feed to the unit are vaporized and removed in the vapor phase effluent. The low-hydrogen high molecular weight molecules in the feed are destructively distilled into a lower molecular weight product molecule and a highly carbonaceous molecule deposited on the circulating solids. At this point a quick separation of vapor and circulating solids is performed to minimize undesirable secondary cracking. The highly carbonaceous molecule contains the majority of the metals, nitrogen, asphaltenes and some heavy sulfur compounds and collectively form coke deposits on the circulating solids which are combusted in the regenerator. Further details on the 3D process may be obtained from U.S. Pat. Nos. 4,859,315 and 4,944,845.

The embodiment of the subject invention in which an existing hydrotreater is modified may be characterized as a method of revamping a multireactor residue hydrotreating unit, said unit comprising a first high pressure separator, a first low pressure flash separator and at least three reactors which method comprises the steps of adding a second high pressure separator and a second low pressure flash separator to the hydrotreating unit; providing means to direct the effluent of the next-to-last reactor of the hydrotreating unit to the second high pressure separator; providing means to direct a liquid phase stream removed from the second high pressure separator into a carbon, and therefore asphaltene, rejection unit chosen from the group consisting of a vacuum fractionation column, a solvent deasphalting unit, a coking unit, a 3D process unit, a visbreaking unit and a thermal cracking unit; and providing means to direct a distillate product stream recovered from the carbon rejection unit into the last reactor of the hydrotreating unit, with the effluent of the last reactor being discharged into the first high pressure separator for the recovery of the product of the hydrotreating unit. In a variation of this method at least a portion, and if desired, all of the hydrotreating catalyst present in the last reactor is replaced with a catalyst having an increased cracking activity relative to the hydrotreating catalyst; e.g. hydrocracking catalyst.

As used herein the term "rich" is intended to indicate a concentration of the specified compound or class of compounds greater than 50 mole percent and preferably greater than about 70 mole percent. The term "residue" is generally but not exclusively used to refer to a process stream removed from either a vacuum or atmospheric fractionation column as a bottoms stream. A residue is typically a very heavy (very high average boiling point) stream containing significant concentrations of sulfur; e.g., greater than 2 wt. %, asphaltenes and an API of less than 200. Distillate hydrocarbons include those boiling in a naphtha boiling range of about 25° C. to about 210° C., diesel fuel boiling range of from about 170° C. to 350° C. and heavy gas oil boiling range extending from about 325° C. to 475° C.

The term "high pressure separator" is used in its normal sense to refer to a vapor-liquid separator which is operated at close to the pressure of an immediately upstream reactor and receives the unseparated effluent of this reactor. The term "hot flash separator" is also used in its normal sense to refer to a vapor-liquid separator which is operated at a significantly lower pressure than the reactor and receives a mixed-phase stream formed from a liquid stream removed from an upstream separator. The function of the high pressure separator is to recover hydrogen from the reactor effluent at a pressure substantially equal to reactor pressure to facilitate recycle of the hydrogen-rich gas to the reaction zone. The hot flash separator normally removes light hydrocarbons; e.g., $C_6$-minus hydrocarbon.

Hydroprocessing encompasses several related refining areas including hydrotreating, which includes hydrodesulfurization and hydrogenation, and hydrocracking. Often the term hydrorefining is also used. As used herein the meaning of these terms is basically governed by the description on pages 174–175 of *The Oil and Gas Journal* of Oct. 8, 1968. These processes resemble one another in their overall flow and their operating conditions often overlap. The primary difference is in the objective of the process and the catalyst used to perform the process. In general operating conditions for any of these processes is set by such factors as the composition of the feed, the desired level of processing to be achieved and the performance characteristics of the chosen catalyst. Table A of U.S. Pat. No. 5,198,100 is incorporated herein for its teaching of hydrotreating conditions for specific feedstreams. Hydrotreating conditions for residue feeds in general include a temperature of about 330 to 460° C., a pressure of about 5,520–24,130 kPa (800–3500 psig), a hydrogen circulation rate of about 1,000 to 10,000 SCF/B and a space velocity of about 0.05 to about 2.5 $hr^{-1}$, preferably about 0.1 to 2.0 $hr^{-1}$. Further information on hydrotreating catalysts, techniques and operating conditions for residue feeds may be obtained by reference to U.S. Pat. Nos. 5,198,100; 4,810,361; 4,810,363; 4,588,709; 4,776,945 and 5,225,383 which are incorporated herein for this teaching.

Referring now to the Drawing, FIG. 1 illustrates the overall configuration of a petroleum refinery employing the subject invention. A stream of crude oil from line 1 is fed into an atmospheric pressure crude column 2. The design and operation of the crude column separates the entering hydrocarbons into several distillate streams removed through lines 3, 4 and 5. Typically these streams would include a light hydrocarbon stream, a naphtha hydrocarbon stream, a jet fuel or diesel stream, and a gas oil stream. The hydrocarbons removed in these streams are suitable for further treatment and processing normally without extensive primary conversion. The bottoms or residue stream of the crude column 2 is removed through line 6 and forms the feed stream to the subject process. The feed stream of line 6 is passed into the hydrotreating zone 16 shown as containing four reactors labeled "A", "B", "C" and "D". The entering feed stream, any recycle stream and hydrogen from a hydrogen-rich gas stream pass in turn through reactors A, B, and C with lines 7 and 8 being used to interconnect these reactors. In a normal prior art configuration the effluent of reactor C would be transferred into reactor D, the final reactor in the hydrotreating zone. However, in the subject invention, the effluent of the next to last reactor C is removed through line 9, and the liquids recovered from this effluent are passed into a vacuum fractionation column 10. Separation of gases from the effluent is not shown in this figure. The vacuum fractionation column 10 removes substantially all of the gas oils, distillate and light hydrocarbons present in the effluent of reactor C. The light hydrocarbons and distillate hydrocarbons boiling in a naphtha and jet fuel boiling point ranges are removed through line 14. The remaining very high boiling point hydrocarbons are withdrawn from the bottom of the vacuum fractionation column 10 as a net bottoms stream flowing through line 11.

In an alternative embodiment all or a portion of the liquid hydrocarbons recovered from the effluent of the third reactor C of the hydrotreating zone are passed through line 22 into line 11 and then transferred into the carbon rejection zone 12. The carbon rejection zone 12 may be one of a number of different types of separation and/or upgrading units which basically functions to separate the entering hydrocarbons into a distillate fraction removed through line 13 and a heavy fraction removed through line 23. For instance, the carbon rejection unit 12 may be a solvent deasphalting zone in which the lighter hydrocarbons are concentrated into the stream removed through line 13 and the heavy asphaltene containing hydrocarbons are concentrated into the residue removed through line 23. The distillate and gas oil hydrocarbons recovered in the vacuum fractionation column 10 and the lighter phase recovered in the carbon rejection unit 13 are then combined and passed through line 15 into the fourth reactor D of the hydrotreating zone 16.

As most of the most highly difficult to treat hydrocarbons present in the effluent reactor C have been discarded via line 23, the material entering the fourth reactor D is much easier to hydrotreat. Improved hydrotreating may therefore be obtained in reactor D and, or as an alternative, some conversion as by hydrocracking of the entering materials can be performed. There is thereby produced as the effluent of the reactor D the desired hydrotreated residue which is the actual product of the subject invention. This product stream is then combined with any portion of the recovered light material and gas oil which is bypassed around reactor D through line 18 and passed via line 19 into a conversion zone 20 such as an FCC unit or hydrocracking unit. This produces a final conversion zone effluent stream comprising high quality distillate hydrocarbons removed via line 21.

Those familiar with the art will readily appreciate that many necessary process stream transfer lines, and other features have not been shown on FIG. 1. For instance, it is not illustrated that light ends are removed from the hydrotreating zone 16 or from the carbon rejection unit 12, which may occur in some instances only. No hydrogen flows are shown on the drawing and no heat exchange is illustrated on the drawing. The Figure nevertheless accomplishes its intended objective of illustrating the arrangement of the various basic units involved with the practice of the subject invention.

Figure 2:
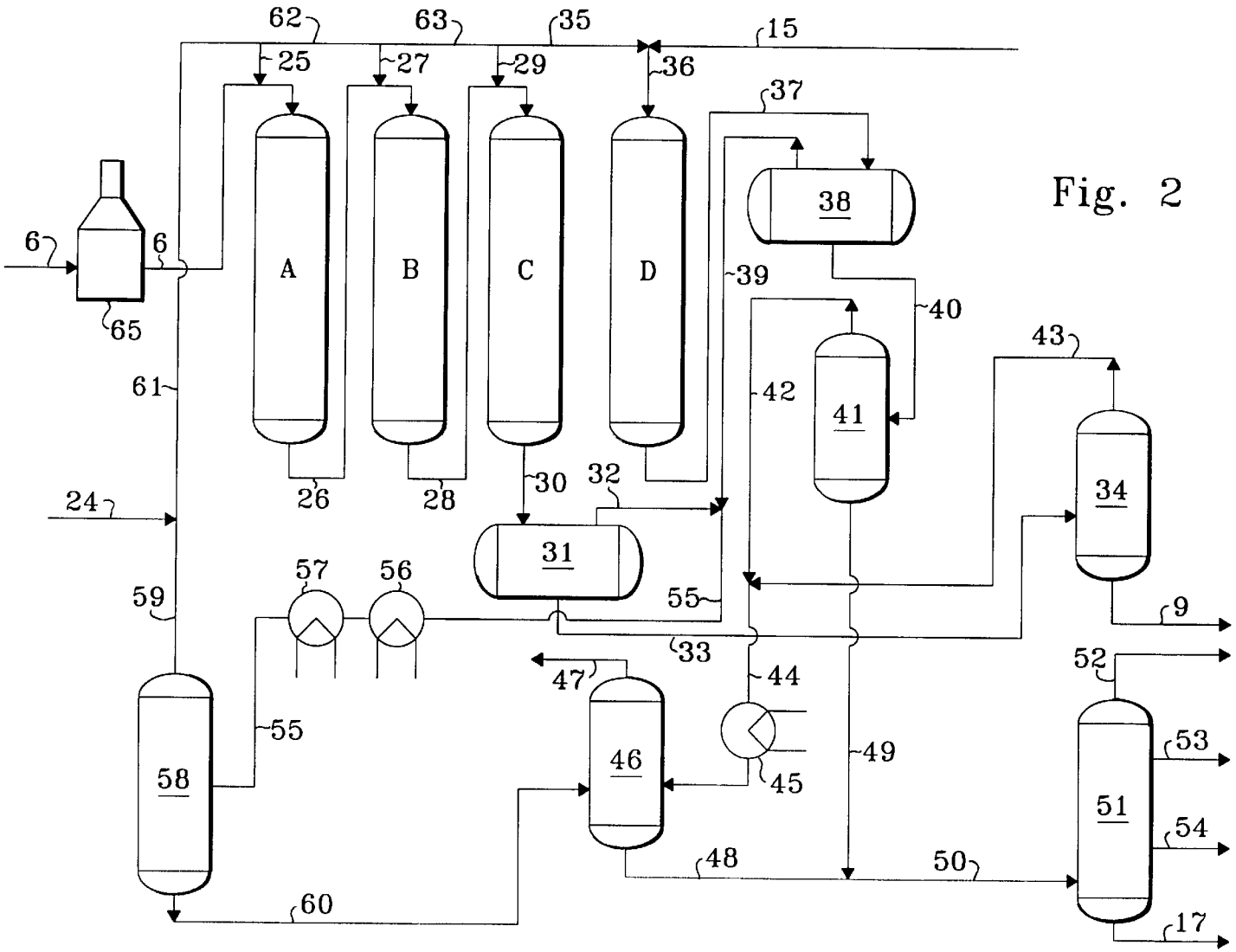
FIG. 2 is a simplified flowscheme giving more details of the four reactors and the separators present within the hydrotreating unit 16 of FIG. 1.

FIG. 2 gives a more detailed illustration of the various components located within the hydrotreating unit 16. Where appropriate the same line numbers as FIG. 1 have been employed. For instance, the feed stream to the hydrotreating unit enters through line 6. The upgraded distillate from the carbon rejection and fractionation column enters through line 15. The liquid phase effluent of the third reaction zone is withdrawn through line 9. The hydrotreated resid material, which is the final product of the invention, is removed through line 17. While this Figure presents more detail than FIG. 1 as to the layout and operation of one embodiment of the hydrotreating zone, it still does not illustrate all of the equipment and process streams normally employed in a zone of this nature. For instance, it does not illustrate the combined feed/effluent heat exchange normally employed on such a process, or the treatment of the hydrogen recycle gas stream for the removal of acid gases such as hydrogen sulfide, compressors, control valves, vessel internals, and the various other normal process flow regulation equipment employed on such a refining unit. All of this equipment is of customary design and does not form a part of the subject invention.

Referring specifically to FIG. 2, the resid crude of line 6 is passed through a fired heater 65 and then combined with a first portion of a hydrogen-rich gas stream carried by line 25. Alternatively, a portion or all of the recycle hydrogen (except for quench) may be passed into the fired heater 65. This hydrogen stream supplies the necessary hydrogen to achieve the desired hydrogen to hydrocarbon ratio within the first hydrotreating reactor A. The resid feed and hydrogen pass through one or more beds of hydrotreating catalyst located within reactor A before emerging into line 26. A second portion of hydrogen-rich gas is added via line 27 primarily as a quench gas stream to lower the temperature of the effluent reactor A. The admixture of the effluent of reactor A and the added hydrogen is then passed into reactor B with additional hydrotreatment such as desulfurization and denitrification occurring within this reactor. The effluent of reactor B is transferred through line 28 and is first admixed with additional quench hydrogen from line 29. This entire admixture is then passed into the third hydrotreating reactor, reactor C. The additional hydrotreating performed in this reactor results in the formation of a reaction zone effluent stream comprising an admixture of hydrogen, unconverted feed hydrocarbons, treated feed hydrocarbons and various byproducts having a variety of boiling points ranging from methane through jet fuel. While the conversion to lighter products is normally held to a minimum through catalyst selection and operating conditions selection, some conversion to lighter products inevitably occurs during a hydrotreating process. This admixture is passed into the hot high pressure separator 31 through line 30. The mixed phase effluent of reactor C is therein separated into a vapor phase stream removed through line 32 and a liquid phase stream removed through line 33. The liquid phase stream is passed through a pressure reduction control valve not shown into a hot low pressure flash zone 34.

The hot low pressure flash zone 34 is designed and operated to separate the entering mixed phase materials into a vapor phase removed through line 43 and a liquid phase stream removed through line 9. The liquid phase stream of line 9 represents the heavier material originally present in the effluent of hydrotreating reactor C. It is this material which is passed into the vacuum fractionation column 10 and/or the carbon rejection unit 12 for asphaltene removal. The entire content of line 33 could be passed directly into the vacuum column 10 instead of being passed through the sequence of two separation vessels. However, the separation vessels are a more efficient means to remove the dissolved hydrogen, light hydrocarbons and distillate hydrocarbons from the effluent of the third reactor than employing the fractionation column. This is especially the case when fractionation column 10 is a vacuum fractionation column.

Vacuum gas oils from the vacuum unit, if present, and the upgraded or liquid product of the carbon rejection unit are passed into the fourth reactor D of the hydrotreating zone via line 15. Prior to entrance into the reactor, they are admixed with an additional quantity of hydrogen-rich gas carried by line 35 with the admixture flowing through line 36. The admixture is then passed into contact with one or more beds of selected hydroprocessing catalyst located within reactor D. These catalysts may be hydrotreating catalysts, hydrocracking catalysts, or a mixture of hydrotreating and hydrocracking catalysts The reduced content of asphaltenes and other heavy materials in the feed to this reactor results in increased levels of hydrotreating activity above that which would normally be achievable in the fourth reactor or alternatively allows for increased capacity or for some hydrocracking and the production of desirable distillate compounds as described in the listing of advantages of the subject invention presented above.

The effluent of reactor D will again comprise a very broad boiling mixture of hydrocarbons, reaction byproducts such as hydrogen sulfide, ammonia, and unconsumed hydrogen. This mixed phase admixture is removed from reactor D through line 37 and passed into a second hot, high pressure separator 38. In general, the effluent of reactor D is processed in a manner similar to the effluent of reactor C. The effluent of reactor D is therefore separated into a vapor phase stream removed through line 39 and a liquid phase portion removed through line 40. The vapor phase stream of line 39 is combined with the vapor phase stream of line 32 and passed into line 55. This vapor phase stream is then cooled through indirect heat exchange means 56 and 57 prior to passage into a cold, high pressure separator vessel 58. This cooling, to a temperature in the order of about 1000 Fahrenheit, causes the condensation of a large weight percentage of the hydrocarbons in the stream of line 55. These hydrocarbons are collected in separator 58 as a liquid phase stream removed through line 60 and passed into the cold, low pressure separator 46. The vapor phase stream separated in vessel 58 is withdrawn through line 59 and passed through a gas treating unit not shown for the removal of hydrogen sulfide. It is then enriched with feed or make up hydrogen from line 24 and passed into line 61 as the recycle hydrogen stream of the process which is circulated by a recycle compressor or compressors not shown.

The liquid phase stream removed from the hot, high pressure separator 38 is passed through line 40 into a hot, low pressure flash zone 41. The liquid phase collected in separator 41 is withdrawn through line 49 and the vapor phase fraction collected in this vessel is withdrawn through line 42. The vapor phase stream of line 42 is combined with the vapor phase stream of line 43 from the other hot, low pressure flash zone 34. This admixed gas stream is passed through line 44 and is cooled by the indirect heat exchanger 45 which affects condensation of substantial hydrocarbons. The resultant mixed phase stream is then passed into the cold, low pressure separator 46. As most of the hydrogen has been removed from the effluent in the hot, high pressure separation vessels 31 and 38, this stream does not contain significant amounts of hydrogen and the vapor phase stream recovered through line 47 is passed to light hydrocarbon product recovery equipment.

The liquid phase stream produced in the cold, low pressure separator 46 is combined with the liquid phase material carried by line 49 from the hot, low pressure flash zone 41 and transported through line 50 into a fractionation column 51. This column separates the entering liquids into a stream of light hydrocarbons removed through line 52, a stream of naphtha boiling range hydrocarbons removed through line 53, a stream of jet fuel boiling range hydrocarbons removed through line 54 and a stream of hydrotreated heavy distillate removed through line 17. The material removed through line 17 will be more highly refined than the material removed through line 9 and represents a hydrotreated gas oil which has been recovered from the feed stream as the basic product of the overall process. This product stream will have a flow rate equal to 50 to 80 volume % of the feed to the hydrotreating zone.

FIG. 2 also illustrates the changes from the normal or preexisting hydrotreating unit process flow which is necessary to convert or revamp the unit into the subject invention. The original hot, high pressure separator and hot, low pressure flash vessels are retained to treat the effluent of the fourth reactor. A new hot, high pressure separator and hot, low pressure flash vessel are added to treat in a similar manner the effluent of the third reactor. These two vessels are essentially mere images of each other for the effluent streams of these two reactors. The streams of a similar nature produced in these vessels are then combined and treated together as appropriate.

The subject invention can conceivably be applied to a hydrotreating zone which contains only two reactors, but it is very highly preferred that the hydrotreating zone contains at least three reactors. The hydrotreating zone most preferably contains four reactors and could contain five or more reactors. Each of the reactors contains one or more beds of hydroprocessing catalyst. The initial reactor(s) contain a hydrotreating catalyst(s). The final reactor may contain hydrotreating catalyst like the initial reactors or a different type of catalyst. In one embodiment of the invention the final reactor contains a catalyst having a hydrocracking function to increase the yield of distillate hydrocarbons recovered from the hydrotreating zone.

The operation of the hydrotreating zone, other than necessary to implement the subject invention, is conventional in nature and is performed at relatively normal conditions. Likewise, the composition of the catalyst does not form a part of the invention and commercially available catalysts are suitable for use in all of the reactors. The hydrotreating catalyst normally comprises one or more hydrogenation components such as platinum, nickel, nickel and tungsten, cobalt and molybdenum supported on an inorganic oxide support typically made of porous alumina. A modern hydrocracking catalyst typically contains a zeolite such as a dealuminated Y zeolite in addition to a hydrogenation component and an inorganic oxide support. The support of a hydrocracking catalyst often contains some acidic material such as silica or silica-alumina.

What is claimed:

1. A petroleum residue desulfurization process which comprises the steps of:

(a) passing a heavy petroleum fraction feed stream having a 50 percent boiling point above about 260° C. and containing at least 0.2 weight percent sulfur into a hydrotreating zone containing at least two reactors, with at least the first reactor containing a hydrotreating catalyst and operated at hydrotreating conditions, passing the feed stream through at least the first reactor in admixture with hydrogen, and then removing the effluent of the next-to-last reactor from the hydrotreating zone, prior to passage through the last reactor of the zone, as a partially hydrotreated residue stream;

(b) separating hydrogen and light hydrocarbons from the partially hydrotreated residue stream, and then passing the remaining portion of the partially hydrotreated residue stream into a processing zone in which asphaltenes are concentrated into a high boiling residue stream and the remaining hydrocarbons are concentrated into a distillate stream;

(c) passing the distillate stream and hydrogen through the last reactor of the hydrotreating zone and recovering a hydrotreated product stream having a 50 percent boiling point above about 260° C.

2. The process of claim 1 wherein the last reactor of the hydrotreating zone contains the same hydrotreating catalyst as the first reactor of the hydrotreating zone.

3. The process of claim 1, wherein the hydrotreating zone contains at least three reactors.

4. The process of claim 1 wherein distillable hydrocarbons are removed from the partially hydrotreated residue stream by a sequence of separatory equipment comprising a high pressure separator, a low pressure flash separator and a fractionation column.

5. The process of claim 1 wherein the processing zone comprises a solvent deasphalting unit.

6. The process of claim 1, wherein prior to passage into the processing zone, distillate hydrocarbons are removed from the remaining portion of the partially hydrotreated residue stream by vacuum fractionation.

7. A process for the desulfurization of a heavy petroleum fraction which comprises the steps of:

a) passing a feed stream having a 50 percent boiling point above about 316° C. into the first reactor of a multireactor hydrotreating unit comprising at least three reactors linked in a series flow arrangement, contacting the feed stream with a hydrotreating catalyst at hydrotreating conditions during passage through at least two reactors, and thereby forming a mixed-phase intermediate process effluent stream which is withdrawn from the next to last reactor of the hydrotreating unit;

b) separating the intermediate process effluent stream in a first high pressure separator into a liquid-phase first process stream comprising hydrocarbons having boiling points above about 316° C. and a vapor-phase second process stream comprising hydrogen and light hydrocarbons;

c) flashing the first process stream into a first flash separator and thereby producing a liquid-phase third process stream comprising hydrocarbons having boiling points above about 316° C. and also producing a vapor-phase fourth process stream comprising light hydrocarbons;

d) passing the third process stream through a carbon rejection unit or a vacuum fractionation unit in which asphaltenes are separated from the third process stream to produce a high-boiling residue stream and a distillate stream comprising hydrocarbons boiling above about 316° C.;

e) passing at least a portion of the distillate stream into the last reactor of the hydrotreating unit, which reactor is operated at hydroprocessing conditions and contains a bed of hydroprocessing catalyst, and thereby forming a hydrotreating unit effluent stream comprising hydrogen, light hydrocarbons and hydrotreated hydrocarbons having boiling points above about 316° C.; and, f) passing the hydrotreating unit effluent stream into a product recovery zone comprising a second high pressure separator and a second flash separator and recovering from the hydrotreating unit effluent stream a hydrotreated product stream which is passed into a conversion unit.

8. The process of claim 7 wherein the third process stream is passed into a vacuum fractionation column, a bottoms stream removed from the vacuum fractionation column is passed into a carbon rejection zone.

* * * * *